US009587818B2

(12) United States Patent
Kim et al.

(10) Patent No.: US 9,587,818 B2
(45) Date of Patent: Mar. 7, 2017

(54) LED LIGHTING APPARATUS WITH IMPROVED HEAT RADIATION PROPERTY

(71) Applicant: SILICON WORKS CO., LTD., Daejeon-si (KR)

(72) Inventors: Yong Geun Kim, Suwon-si (KR); Sang Young Lee, Jeonju-si (KR); Ki Chul An, Daegu-si (KR); Eun Ji Jo, Daejeon-si (KR); Yun Hee Ra, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 0 days.

(21) Appl. No.: 14/853,112

(22) Filed: Sep. 14, 2015

(65) Prior Publication Data

US 2016/0076753 A1 Mar. 17, 2016

(30) Foreign Application Priority Data

Sep. 15, 2014 (KR) ..... 10-2014-0121777

(51) Int. Cl.
*H05B 37/00* (2006.01)
*F21V 29/10* (2015.01)
(Continued)

(52) U.S. Cl.
CPC ..... *F21V 29/10* (2015.01); *H05B 33/0824* (2013.01); *H05B 33/0845* (2013.01); *F21Y 2101/00* (2013.01)

(58) Field of Classification Search
CPC ..... F21V 29/10; F21V 29/002; F21V 29/004; F21V 29/02; H05B 33/0824; H05B 33/0845
See application file for complete search history.

(56) References Cited

U.S. PATENT DOCUMENTS 4,298,869 A * 11/1981 Okuno ..... G08B 5/36 257/88
6,956,494 B2 * 10/2005 Tichborne ..... B61L 5/1881 340/332

(Continued)

FOREIGN PATENT DOCUMENTS

JP 2014-85918 5/2014
JP 2014-157795 8/2014

(Continued)

*Primary Examiner* — Jason M Crawford
*Assistant Examiner* — Kurtis R Bahr
(74) *Attorney, Agent, or Firm* — Kile Park Reed & Houtteman PLLC

(57) ABSTRACT

Provided is an LED lighting apparatus with an improved heat radiation property, which is capable of effectively radiating heat generated therein. The LED lighting apparatus may include: a light source unit comprising a plurality of LED groups each having one or more LEDs; and a driving unit configured to provide a current path corresponding to light emission of the light source unit. The light source unit and the driving unit may be arranged on the same substrate so as to be separated from each other. Among the plurality of LED groups, the LED group having the largest heat value may be arranged farthest away from the driving unit, compared to the other LED groups. Through the above-described arrangement, the heat radiation property of the LED lighting apparatus can be improved.

13 Claims, 4 Drawing Sheets

(51) Int. Cl.
*H05B 33/08* (2006.01)
*F21Y 101/00* (2016.01)

(56) References Cited

U.S. PATENT DOCUMENTS

2011/0316014 A1* 12/2011 Hiroyuki ..... F21V 23/005
257/89
2013/0320870 A1* 12/2013 Oyaizu ..... F21K 9/1355
315/192
2014/0043803 A1* 2/2014 Kawashima ..... F21V 21/00
362/231
2014/0097753 A1* 4/2014 Hui ..... H05B 33/089
315/112

FOREIGN PATENT DOCUMENTS

KR 10-2011-0019080 2/2011
KR 10-2011-0125083 11/2011
KR 10-1308698 * 9/2013 ..... H05B 37/02

* cited by examiner

LED LIGHTING APPARATUS WITH IMPROVED HEAT RADIATION PROPERTY

BACKGROUND

1. Technical Field

The present disclosure relates to an LED lighting apparatus, and more particularly, to an LED lighting apparatus with an improved heat radiation property, which is capable of effectively radiating heat generated therein.

2. Related Art

In order to reduce energy, a lighting apparatus is designed to use a light source having high light emission efficiency based on a small amount of energy. Recently, an LED has been used as a representative light source of the lighting apparatus. The LED is differentiated from other light sources in terms of various aspects such as energy consumption, lifetime, and light quality.

Since the LED is driven by a current, a lighting apparatus using the LED as a light source requires a large number of additional circuits for current driving.

In order to solve the above-described problem, an AC direct-type lighting apparatus has been developed to provide an AC voltage to the LED.

The AC direct-type lighting apparatus is configured to convert an AC voltage into a rectified voltage, and control the LED to emit light through a current driving operation using the rectified voltage. Since the AC direct-type LED lighting apparatus uses a rectified voltage without using an inductor and capacitor, the AC direct-type LED lighting apparatus has a satisfactory power factor. The rectified voltage indicates a voltage obtained by full-wave rectifying an AC voltage.

The lighting apparatus may include a light source unit, a power supply unit, and a driving unit. The light source unit may include a plurality of LED groups, the power supply unit may provide a rectified voltage using an AC voltage, and the driving unit may drive the light source unit.

Among the units of the lighting apparatus, the LED groups of the light source unit generate heat at a considerably high temperature, when emitting light, and the driving unit also generates heat at a high temperature due to a driving current corresponding to the light emission.

When the heat of the LED groups or the driving unit is not effectively discharged, a line pattern may float due to a difference in thermal expansion coefficient between the line pattern and a printed circuit board (PCB) or the lifetime of the LEDs included in the LED groups may be reduced by accumulated thermal fatigue.

The driving unit is arranged on the PCB without considering the influence of heat radiated from the LED groups. Thus, the driving unit may be positioned in the environment which is not suitable for heat radiation. When the heat radiation is not smoothly performed due to such an environment, the driving performance and reliability of the driving unit may be reduced.

For such reasons, the light emission property and brightness of the LEDs may be degraded, and the entire driving performance and reliability of the lighting apparatus may be degraded.

Thus, the lighting apparatus needs to be designed to have an improved heat radiation property.

SUMMARY

Various embodiments are directed to an LED lighting apparatus capable of improving the heat radiation property thereof by improving the arrangement of LED groups and a driving unit, improving the light emission characteristic and brightness of LEDs, and improving the driving performance and reliability thereof.

Also, various embodiments are directed to an LED lighting apparatus in which the LED group having the largest heat value among a plurality of LED groups is arranged farthest away from the other LED groups, thereby improving the driving environment of a driving unit.

Also, various embodiments are directed to an LED lighting apparatus which determines the positions at which a plurality of LED groups are arranged, in consideration of heat values, thereby improving the heat radiation property thereof.

In an embodiment, an LED lighting apparatus may include: a light source unit comprising a plurality of LED groups each having one or more LEDs; and a driving unit configured to provide a current path corresponding to light emission of the light source unit. The light source unit and the driving unit may be arranged on the same substrate so as to be separated from each other. Among the plurality of LED groups, the LED group having the largest heat value may be arranged farthest away from the driving unit, compared to the other LED groups.

DETAILED DESCRIPTION

Figure 1:
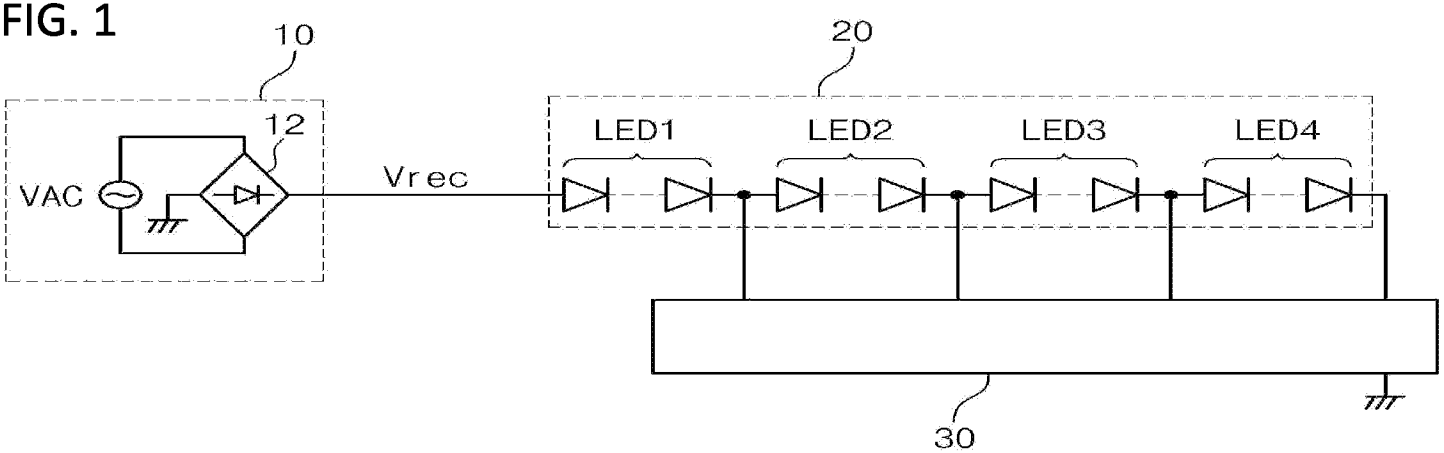
FIG. 1 is a diagram schematically illustrating an LED lighting apparatus with an improved heat radiation property in accordance with an embodiment of the present invention.

Hereafter, exemplary embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

FIG. 1 is a diagram schematically illustrating an LED lighting apparatus with an improved heat radiation property in accordance with an embodiment of the present invention.

The LED lighting apparatus with an improved heat radiation property in accordance with the embodiment of the present invention may include a power supply unit 10, a light source unit 20, and a driving unit 30. The light source unit 20 may include a plurality of LED groups.

The power supply unit 10 may output a rectified voltage Vrec obtained by converting an AC voltage, and include an AC voltage source VAC and a rectifier circuit 12. The AC voltage source VAC may supply the AC voltage, and the rectifier circuit 12 may rectify the AC voltage and output the rectified voltage Vrec. The AC voltage source VAC may include a commercial AC voltage source.

The rectifier circuit 12 may full-wave rectify a sine-wave AC voltage of the AC voltage source VAC, and output the rectified voltage Vrec. Thus, the rectified voltage Vrec may have a ripple in which the voltage level thereof rises/falls on a basis of the half cycle of the commercial AC voltage.

The light source unit 20 may include a plurality of LED groups connected in series. In the embodiment of the present invention, an LED lighting apparatus including four LED groups will be taken as an example for description. However, the number of LED groups will be freely adjusted according to the capacity of the lighting apparatus.

Each of the LED groups LED1 to LED4 may include one or more LEDs connected in series or parallel. In the embodiment of the present invention, suppose that each of the LED groups LED1 to LED4 includes a plurality of LEDs connected in series. In FIG. 1, only the first and last LEDs among the plurality of LEDs connected in series are illustrated, and the connection relation of the LEDs in the middle is omitted and illustrated as a doted line.

The LED groups LED1 to LED4 of the light source unit 20 may be sequentially turned on or off in response to changes of the rectified voltage Vrec.

The driving unit 30 may provide a current path in response to light emission of the LED groups LED1 to LED4. At this time, the driving unit 30 may provide different current paths to the respective LED groups LED1 to LED4.

The driving unit 30 may sense a driving current flowing through the current paths, and regulate the driving current on the current paths for sequentially turning on/off the LED groups LED1 to LED4.

Figure 2:
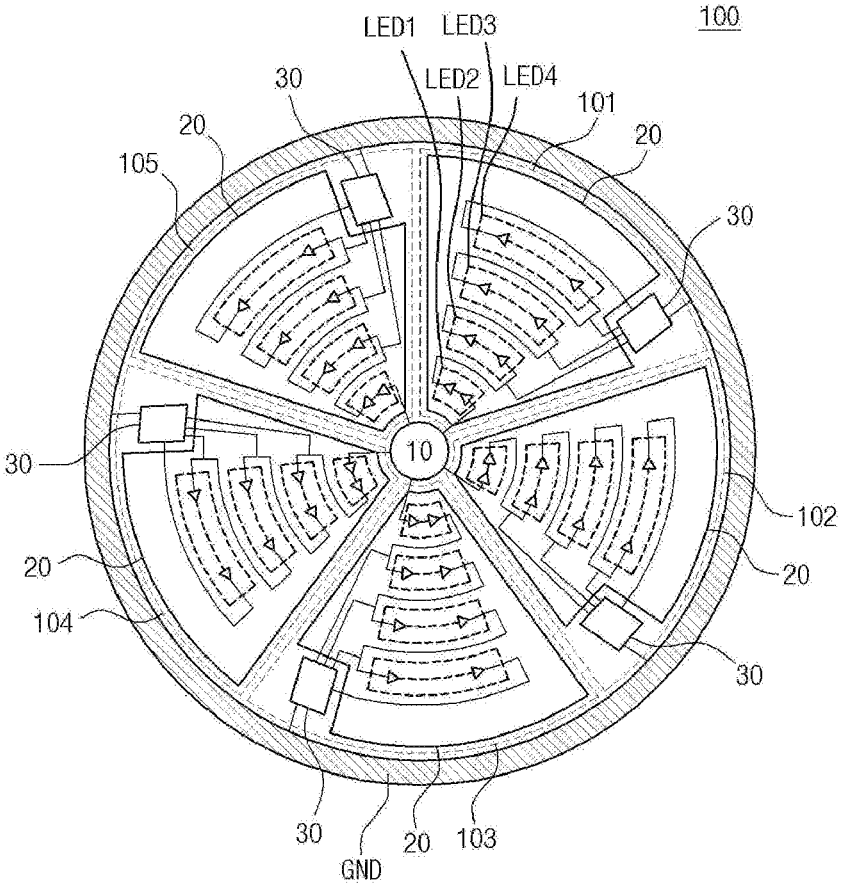
FIG. 2 is a diagram illustrating the arrangement structure of a substrate forming the LED lighting apparatus in accordance with the embodiment of the present invention.

FIG. 2 is a diagram illustrating the arrangement structure of a substrate forming the LED lighting apparatus with an improved heat radiation property in accordance with the embodiment of the present invention.

Referring to FIG. 2, the LED lighting apparatus in accordance with the embodiment of the present invention may include the power supply unit 10, the light source unit 20, and the driving unit 30, which are arranged on the same surface of the substrate 100. The power supply unit 10 and the driving unit 30 may be implemented as a chip and mounted on the substrate 100.

The substrate 100 may be formed in a circuit shape. The power supply unit 10 may be arranged in the center of the substrate 100. The light source unit 20 may be arranged on the substrate 100 around the power supply unit 10, and the driving unit 30 may be arranged at the edge of the substrate 100. The substrate 100 may include a line pattern formed thereon, and the power supply unit 10, the light source unit 20, and the driving unit 30 may be electrically connected through the line pattern. The line pattern may include a line for applying the rectified voltage Vrec from the power supply unit 10 to the light source unit 20, lines for connecting the LED groups LED1 to LED4 of the light source unit 20 to terminals of the driving unit 30, respectively, a ground voltage line GND for grounding, and a line connected to the ground voltage line GND to ground the driving unit 30.

The power supply unit 10 may be arranged in the center of the substrate 100, and supply the rectified voltage Vrec obtained by rectifying the AC voltage to the light source unit 20 and the driving unit 30 through the lines formed on the substrate 100.

In the embodiment of the present invention, the power supply unit 10 for supplying the rectified voltage Vrec may be arranged in the center of the substrate 100, and the ground voltage line GND may be formed at the edge of the substrate 100.

When the ground voltage line GND is formed at the edge of the substrate, the pattern of the lines for the LED groups may be easily implemented. At a region where power is unstable, a large amount of leakage current may occur. However, when the ground voltage line GND is formed at the edge of the substrate 100, the ground voltage line GND may protect the internal device from noise such as leakage current. Thus, the lighting apparatus may be stably operated.

The light source unit 20 may include a plurality of LED groups each including a plurality of LEDs.

Among the plurality of LED groups, the LED group LED1 having the largest heat value in response to light emission may be arranged at the center of the substrate 100, compared to the other LED groups. Furthermore, the LED group radiating the smallest heat value may be arranged at the edge of the substrate 100.

When the LED group LED1 having the largest heat value is arranged close to the center of the substrate, the LED group LED1 may be arranged farthest away from the driving unit 30 positioned at the edge. Then, the influence of heat generated from the LED group LED1 on the driving unit 30 implemented as an integrated circuit chip can be minimized.

The driving unit 30 may be arranged farthest away from the center of the substrate 100 or at the edge of the substrate 100. When the driving unit 30 is arranged at the edge of the substrate 100, the heat generated from the driving unit 30 may be more easily discharged to the outside of the substrate 100 than when the driving unit 30 is arranged close to the center of the substrate 100.

When the temperature of an integrated circuit chip rises, a problem may occur in the reliability of operation thereof. In the embodiment of the present invention, as the driving unit 30 is arranged at the edge of the substrate 100, the driving unit 30 may be arranged farthest away from the LED group LED1 having the largest heat value. Thus, the driving unit 30 can effectively discharge heat generated therefrom to the outside, without being influenced by the heat generated from the LED group LED1 having the largest heat value. Thus, the driving unit 30 can be driven in a stable temperature environment in which thermal fatigue is not accumulated.

Only the driving unit 30 and the light source unit 20 may be arranged on the substrate 100, and the power supply unit 10 may be arranged on another substrate.

The light source unit and the driving unit may be mounted on each of a plurality of unit regions 101 to 105 included in one substrate.

When a large-capacity lighting apparatus includes one light source unit and one driving unit on one substrate and a trouble occurs in one or more of the light source unit and the driving unit, the entire functions of the lighting apparatus may not be normally performed or some functions such as brightness control may not be controlled.

In order to solve the problem, the embodiment of the present invention discloses the structure in which the substrate 100 is divided into the plurality of unit regions 101 to 105. The light source unit and the driving unit may be arranged in each of the unit regions 101 to 105, and independently operated. Thus, although a problem occurs in the unit region 101, the light source units and the driving units in the other unit regions 102 to 105 may be normally operated. Thus, it is possible to prevent the above-described problem that the entire functions of the lighting apparatus are not normally performed or some functions such as brightness control are not controlled.

In FIG. 2, the unit regions 102 to 105 may be configured in the same manner as the unit region 101. Thus, illustration of the LED groups LED1 to LED4 in the unit regions 102 to 105 is omitted.

Figure 3:
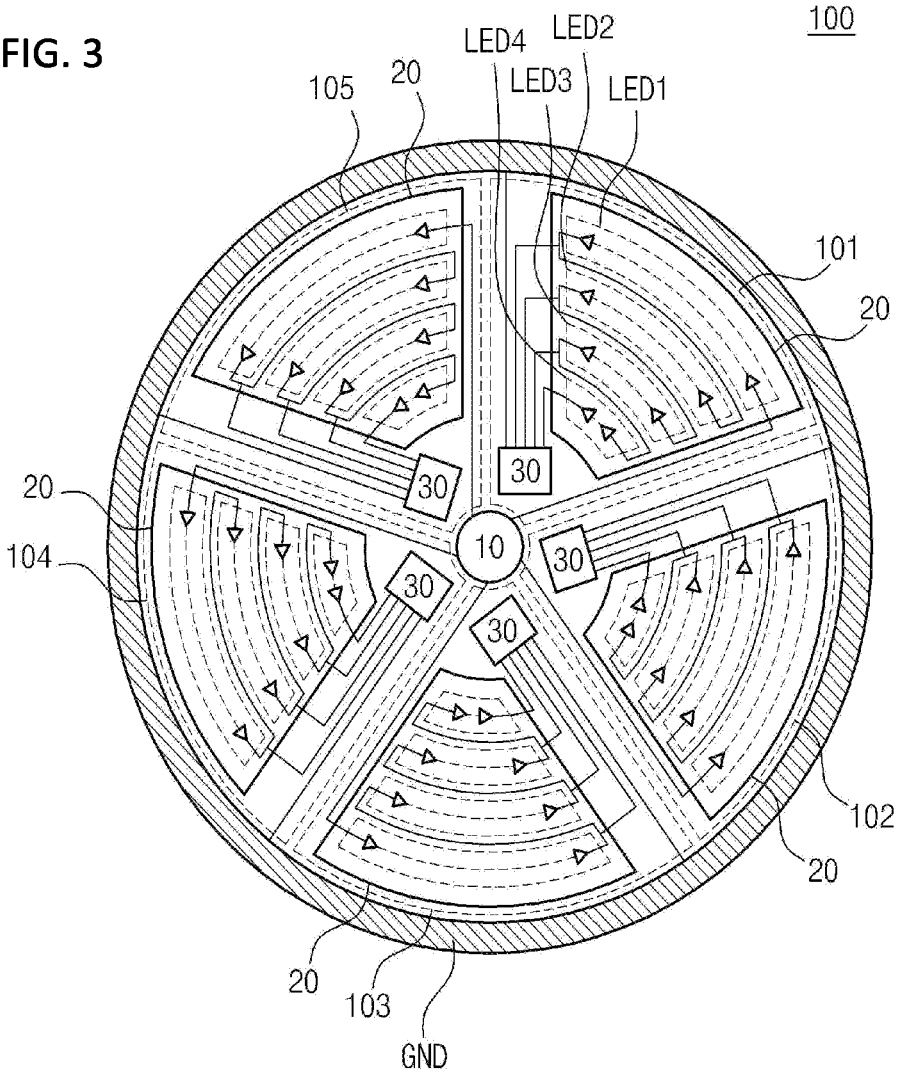
FIG. 3 is a diagram illustrating the arrangement structure of an LED lighting apparatus in accordance with another embodiment of the present invention.

FIG. 3 is a diagram illustrating the arrangement structure of an LED lighting apparatus with an improved heat radiation property in accordance with another embodiment of the present invention.

Referring to FIG. 3, the LED lighting apparatus in accordance with the embodiment of the present invention may include a power supply unit 10 arranged at the center of a substrate 100 formed therein, a driving unit arranged around the power supply unit 10, and a light source unit 20 arranged at the edge of the substrate 100.

The LED lighting apparatus of FIG. 3 is different from the LED lighting apparatus illustrated in FIG. 2 in that the driving unit 30 is arranged at the center of the substrate 100 and the light source unit 20 is arranged at the edge of the substrate 100.

In the case of a general LED lighting apparatus, the driving unit generates a larger amount of heat than the light source unit. In this case, as illustrated in FIG. 2, the light source unit and the driving unit may be arranged to be separated from each other, and the driving unit may be arranged at the edge of the substrate.

However, in the case of an LED lighting apparatus in which the light source unit generates a larger amount of heat than the driving unit, the driving unit may be arranged close to the center of the substrate 100, and the light source unit having a large heat value may be arranged at the edge of the substrate 100, as illustrated in FIG. 3. In this case, the heat of the substrate 100 can be more effectively discharged.

At this time, the LED group LED1 having the largest heat value may be arranged at the edge of the substrate 100, and the LED group having the smallest heat value may be arranged close to the center of the substrate 100.

That is, as the LED group LED1 having the largest heat value is arranged at the edge of the substrate 100, the heat generated from the light source unit 20 can be easily discharged to the outside of the substrate 100. Furthermore, the LED group LED1 having the largest heat value may be arranged farthest away from the driving unit 30, thereby minimizing the influence of heat generated from the LED group LED1 on the integrated circuit chip of the driving unit 30.

Figure 4:
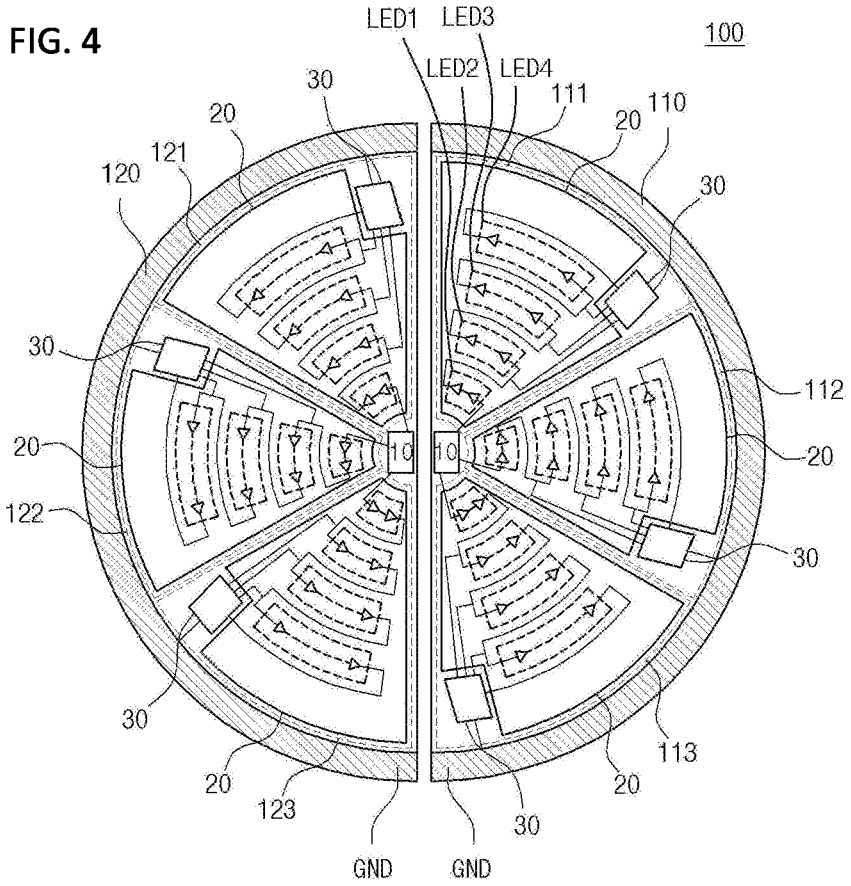
FIG. 4 is a diagram illustrating the arrangement structure of an LED lighting apparatus in accordance with another embodiment of the present invention.

FIG. 4 is a diagram illustrating the arrangement structure of an LED lighting apparatus with an improved heat radiation property in accordance with another embodiment of the present invention.

In the embodiments of FIGS. 2 and 3, the power supply unit, the light source unit, and the driving unit may be arranged on one substrate 100. In the embodiment of FIG. 4, however, the power supply unit, the light source unit, and the driving unit may be arranged on each of two substrates 110 and 120, and independently operated.

When the power supply unit 10, the light source unit 20, and the driving unit 30 are arranged on each of the two substrates 110 and 120 as illustrated in FIG. 4, one substrate 120 may be independently operated even though another substrate 110 is not operated due to a problem. That is, the lighting apparatus can perform a lighting operation through light emission of the LED groups mounted on the substrate 120. Thus, the entire lighting operation of the LED lighting apparatus can be performed without a problem.

The plurality of substrates 110 and 120 may be divided into a plurality of unit regions 111 to 113 and a plurality of unit regions 121 to 123, respectively, and the light source unit 20 and the driving unit 30 may be arranged in each of the unit regions.

As the plurality of substrates are separated from each other by 1 mm or more, the influence between the respective substrates may be minimized. That is, a margin in which the substrates can be extended by heat generation can be secured, and heat exchange therebetween can be reduced.

Furthermore, the light source units 20 and the driving units 30 arranged in the respective unit regions 111 to 113 of the substrate 110 and the light source units 20 and the driving units 30 arranged in the respective unit regions 121 to 123 of the substrate 120 may be symmetrically arranged.

FIG. 4 illustrates two substrates. Depending on embodiments, however, the power supply unit, the light source unit, and the driving unit may be arranged on each of three or more substrates.

FIG. 4 illustrates that the light source unit 20 is arranged close to the center of the substrate and the driving unit 30 is arranged at the edge of the substrate. However, the driving unit 30 may be arranged close to the center of the substrate and the light source unit 20 may be arranged at the edge of the substrate.

In the embodiment of the present invention, an AC direct type lighting apparatus has been taken as an example for description. However, the LED lighting apparatus in accordance with the embodiment of the present invention can be applied to a general LED lighting apparatus as well as the AC direct type lighting apparatus.

In the embodiments of the present invention, the light source unit and the driving unit to drive the LED groups may be arranged to be separated from each other. Thus, as the heat generated from the driving unit and the light source unit is effectively discharged, the damage of the LED groups and the driving units can be prevented, and the lifetime of the LED lighting apparatus can be increased. Therefore, the entire performance of the LED lighting apparatus can be improved.

Furthermore, the driving unit and the light source unit are arranged to be separated from each other, and the LED group having the largest heat value among the plurality of LED groups may be arranged farthest away from the driving unit, thereby minimizing the influence of heat generated from the LED group on the driving unit.

In accordance with the embodiment of the present invention, the arrangement of the driving unit and the LED groups of the light emission unit may be determined in consideration of the heat radiation property. Thus, the heat radiation property of the LED lighting apparatus can be improved, the light emission property and brightness of the LEDs can be improved, and the driving performance and reliability of the LED lighting apparatus can be improved.

Furthermore, among the plurality of LED groups, the LED group having the largest heat value may be arranged farthest away from the driving unit, compared to the other LED groups. Thus, as the driving environment of the driving unit which is relatively vulnerable to heat is improved, the driving performance and reliability can be improved.

Furthermore, the positions at which the plurality of LED groups are arranged may be determined in consideration of heat values. Thus, the heat radiation property of the LED lighting apparatus can be improved.

While various embodiments have been described above, it will be understood to those skilled in the art that the embodiments described are by way of example only.

Accordingly, the disclosure described herein should not be limited based on the described embodiments.

What is claimed is:

1. An LED lighting apparatus comprising:

a light source unit comprising a plurality of LED groups each having one or more LEDs; and a driving unit configured to provide a current path corresponding to light emission of the light source unit, wherein the light source unit and the driving unit are arranged on the same substrate so as to be separated from each other, and among the plurality of LED groups, the LED group having the largest heat value is arranged farthest away from the driving unit, compared to the other LED groups.

2. The LED lighting apparatus of claim 1, wherein the driving unit is arranged at the center of the substrate, compared to the plurality of LED groups.

3. The LED lighting apparatus of claim 1, further comprising a power supply unit configured to provide a rectified voltage using an AC voltage, wherein the power supply unit is arranged in the center of the substrate, and the driving unit is arranged adjacent to the power supply unit.

4. The LED lighting apparatus of claim 1, wherein among the plurality of LED groups, the LED group having the largest heat value is arranged at the center of the substrate, compared to the other LED groups.

5. The LED lighting apparatus of claim 1, wherein a ground voltage line is formed at the edge of the substrate.

6. The LED lighting apparatus of claim 5, wherein among the plurality of LED groups, the LED group having the largest heat value is arranged at the center of the substrate, compared to the other LED groups, and the driving unit is arranged adjacent to the ground line.

7. The LED lighting apparatus of claim 1, wherein among the plurality of LED groups, an LED having a relatively large heat value is arranged far away from the driving unit, and an LED having a relatively small heat value is arranged close to the driving unit.

8. The LED lighting apparatus of claim 7, wherein the plurality of LED groups sequentially emit light from the LED group arranged farthest away from the driving unit to the LED group arranged closest to the driving unit.

9. The LED lighting apparatus of claim 1, wherein the substrate is divided into a plurality of unit regions each including the light source unit and the driving unit, and the light source unit and the driving unit in each of the unit regions are independently operated.

10. The LED lighting apparatus of claim 1, further comprising a power supply unit configured to provide a rectified voltage using an AC voltage, wherein the power supply unit is arranged in the center of the substrate.

11. The LED lighting apparatus of claim 1, wherein the substrate includes a plurality of substrates, each of the substrates includes the light source unit and the driving unit, and in each of the substrates, the LED group having the largest heat value among the plurality of LED groups is arranged farthest away from the driving unit.

12. The LED lighting apparatus of claim 11, wherein the plurality of substrates include two substrates, and the plurality of unit regions included in the respective substrates are symmetrically arranged.

13. The LED lighting apparatus of claim 12, wherein the plurality of substrates are separated from each other by 1 mm or more.

* * * * *